US008754783B2

(12) United States Patent
Jordan

(10) Patent No.: US 8,754,783 B2
(45) Date of Patent: Jun. 17, 2014

(54) ESTIMATING PARKING SPACE OCCUPANCY USING RADIO-FREQUENCY IDENTIFICATION

(75) Inventor: Dwight Jordan, Niota, TN (US)

(73) Assignee: 3M Innovative Properties Company, St. Paul, MN (US)

( * ) Notice: Subject to any disclaimer, the term of this patent is extended or adjusted under 35 U.S.C. 154(b) by 321 days.

(21) Appl. No.: 12/905,867

(22) Filed: Oct. 15, 2010

(65) Prior Publication Data

US 2012/0092189 A1 Apr. 19, 2012

(51) Int. Cl.
*G08G 1/14* (2006.01)

(52) U.S. Cl.
USPC ..... 340/932.2; 340/572.1; 705/13

(58) Field of Classification Search
USPC ..... 340/932.2, 572.1, 10.1; 705/1.1, 32, 13; 707/802
See application file for complete search history.

(56) References Cited

U.S. PATENT DOCUMENTS

| | | | | |
|---|---|---|---|---|
| 6,340,935 | B1 | 1/2002 | Hall | |
| 8,004,426 | B2 * | 8/2011 | Dasgupta | 340/932.2 |
| 2005/0012613 | A1 | 1/2005 | Eckstein et al. | |
| 2005/0040232 | A1 * | 2/2005 | Maloney | 235/385 |
| 2006/0033641 | A1 * | 2/2006 | Jaupitre et al. | 340/932.2 |
| 2007/0046436 | A1 * | 3/2007 | Tanaka | 340/10.2 |
| 2007/0152845 | A1 | 7/2007 | Porte et al. | |
| 2007/0171069 | A1 * | 7/2007 | Allen | 340/572.1 |
| 2007/0247315 | A1 | 10/2007 | Nagai | |
| 2008/0266138 | A1 * | 10/2008 | Ponert | 340/932.2 |
| 2010/0085214 | A1 * | 4/2010 | Kim | 340/932.2 |
| 2011/0153172 | A1 * | 6/2011 | Anderson | 701/50 |
| 2012/0007983 | A1 * | 1/2012 | Welch | 348/148 |
| 2012/0086558 | A1 * | 4/2012 | Teske | 340/10.4 |

FOREIGN PATENT DOCUMENTS

EP 1628278 A1 2/2006

OTHER PUBLICATIONS

International Search Report & Written Opinion in PCT/US2001/053894 mailed Nov. 18, 2011, 8 pages.
IDentity 5200\5204, "IDentity 5200/5204," Sirit Inc., © 2010, 2 pages.
IDentity CCT, "IDentity Card Tag—Ultra High Frequency 865-928 MHz, Global Passive Transponder," Sirit Inc., © 2009, 2 pages.
IDentity ELP, "IDentity External License Plate Transponder—Ultra High Frequency 865-928 MHz, Global Passive Transponder," Sirit Inc., © 2009, 2 pages.
IDentity HMT-NT, "IDentity Headlamp Mount Tag, Non-Transferrable—Ultra High Frequency 865-928 MHz, Global Passive Transponder," Sirit Inc., © 2009, 2 pages.
IDentity WMT-NT, "IDentity Windshield Mount Tag, Non-Transferrable—Ultra High Frequency 865-928 MHz, Global Passive Transponder," Sirit Inc., © 2009, 2 pages.
IDentity WMT-TR, "IDentity Windshield Mount Tag, Transferrable—Ultra High Frequency 865-928 MHz, Global Passive Transponder," Sirit Inc., © 2009, 2 pages.
Park Assist, "Info Center," published Mar. 20, 2010, 2 pages.

(Continued)

*Primary Examiner* — Brent Swarthout

(57) ABSTRACT

An example system configured to determine a status of a parking space includes an RFID reader, and at least one RFID tag positioned at the parking space. The RFID reader interrogates the RFID tag. The RFID reader determines that the parking space is unoccupied when the RFID reader receives a response from the RFID tag. The RFID reader determines that the parking space is occupied when the RFID reader fails to receive the response from the RFID tag.

7 Claims, 7 Drawing Sheets

(56) References Cited

OTHER PUBLICATIONS

Park Assist, "Products," accessed at http://parkassist.com/products.html, accessed on Jan. 14, 2011, 4 pages.

902-928 MHZ 12.5dBi Reader Antenna Data Sheet, Mti Wireless Edge, Ltd., issued Dec. 31, 2006, 2 pages.

IDentity 4100, Ultra High Frequency 902-928MHz; Sirit Inc., © 2008, 2 pages.

Title 21 Antenna (015-Kt), Federal Signal © 2008, 2 pages.

* cited by examiner

600

ESTIMATING PARKING SPACE OCCUPANCY USING RADIO-FREQUENCY IDENTIFICATION

BACKGROUND

Most modern parking systems are partially or fully automated. For example, parking garages typically have entrance meters that allow a vehicle to obtain a ticket as the vehicle approaches the garage. Once the ticket is taken by the driver, the vehicle can enter the garage. Some systems also allow the driver to automatically pay a parking fee prior to leaving the garage.

As part of these automated systems, it is necessary to account for the total occupancy of the garage. For example, it is necessary to provide indicators when the garage is reaching capacity so that the number of vehicles that are allowed to enter the garage is controlled. Further, it can be important for revenue and accounting purposes to accurately account for the number of vehicles within the garage at given points in time.

While such systems typically attempt to track occupancy rates by monitoring the number of vehicles that enter and exit the garage, such systems can be less than optimal. For example, it is possible for multiple vehicles to enter the garage while being counted as a single vehicle (e.g., if one vehicle tail-gates another vehicle upon entry). In other situations, glitches in the entry and/or exit processes can result in inaccurate vehicle counts. Because of such inaccuracies, most parking systems are left with providing a rough estimate of occupancy rates at any given point in time.

SUMMARY

In one aspect, a system configured to determine a status of a parking space includes: an RFID reader; and at least one RFID tag positioned at the parking space; wherein the RFID reader interrogates the RFID tag; wherein the RFID reader determines that the parking space is unoccupied when the RFID reader receives a response from the RFID tag; and wherein the RFID reader determines that the parking space is occupied when the RFID reader fails to receive the response from the RFID tag.

In another aspect, a parking garage includes: a plurality of parking spaces; at least one RFID reader; at least one antenna coupled to the RFID reader; and at least one RFID tag positioned in one of the parking spaces; wherein the RFID reader uses the antenna to interrogate the RFID tag; wherein the RFID reader determines that one of the parking spaces is unoccupied when the RFID reader receives a response from the RFID tag; and wherein the RFID reader determines that one of the parking spaces is occupied when the RFID reader fails to receive the response from the RFID tag.

In yet another aspect, a method for determining an occupancy of a parking space within a parking garage includes: interrogating an RFID tag located at the parking space; determining that the parking space is unoccupied when a response from the RFID tag is received; and determining that that the parking space is occupied when the response from the RFID tag is not received.

DETAILED DESCRIPTION

Figure 1:
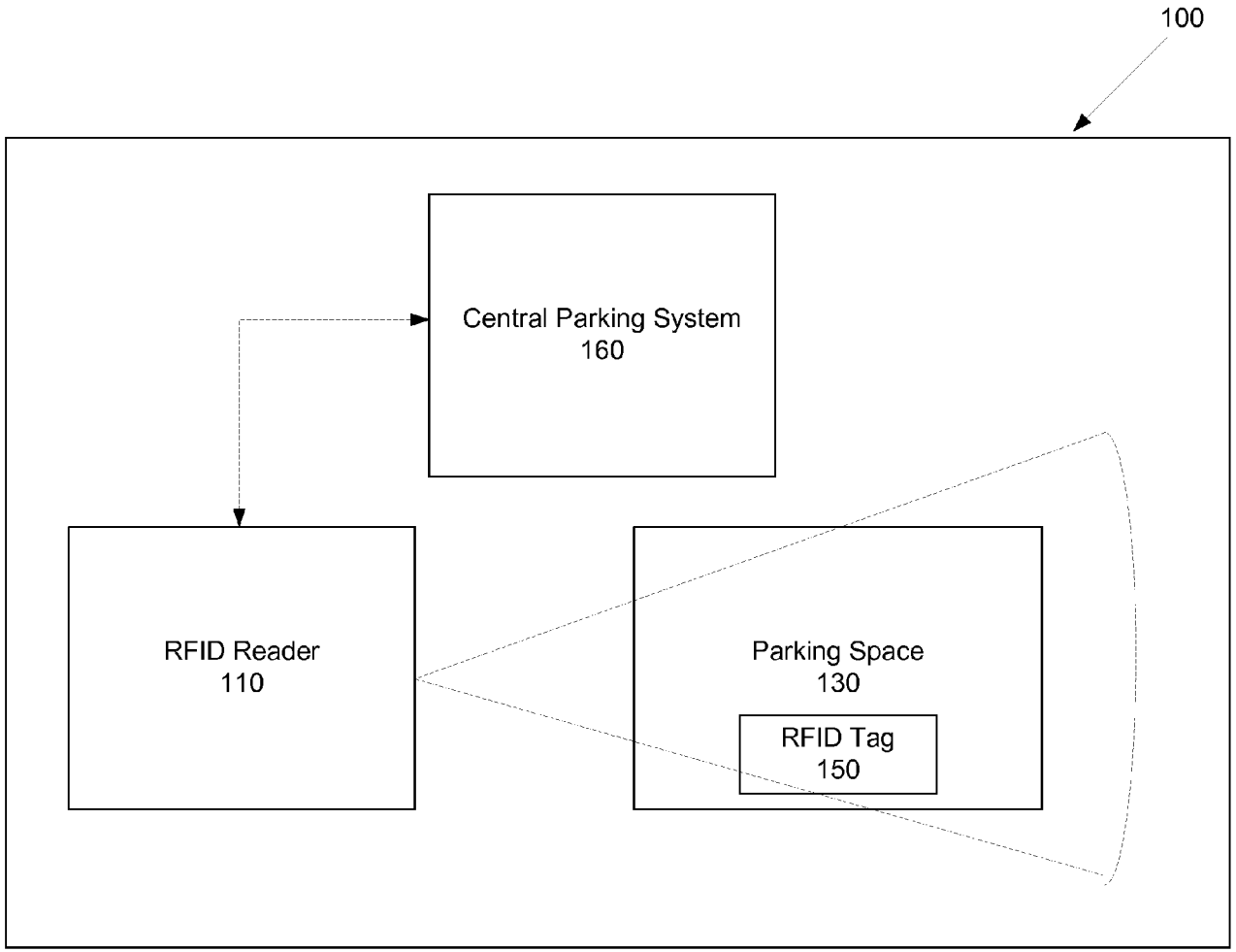
FIG. 1 is a schematic view of a parking garage.

Various embodiments of the present disclosure will be described in detail with reference to the drawings, wherein like reference numerals represent like parts and assemblies throughout the several views. Reference to various embodiments does not limit the scope of the disclosure. Additionally, any examples set forth in this specification are not intended to be limiting and merely set forth some of the many possible embodiments for the present disclosure.

In general, the present disclosure relates to estimating parking space occupancy using radio-frequency identification (RFID). RFID readers and tags are positioned within a parking garage. The RFID readers interrogate the tags positioned at parking spaces within the garage. Based on this interrogation, an estimate of the occupancy of the parking garage can be made.

For example, referring now to FIG. 1, a parking garage 100 is shown. The garage 100 including an RFID reader 110, a parking space 130, and a central parking system 160. Although only a single parking space is shown in this example, garages typically include hundreds or thousands of such spaces.

The parking space 130 is typically demarked by broken or solid lines on the floor of the garage and is sized to accommodate a vehicle, such as an automobile, motorcycle, etc. An RFID tag 150 is positioned within the parking space 130, such as being positioned on or embedded into the floor of the space 130, as described below.

The RFID reader 110 is positioned within the garage 100 so that the RFID reader 110 can periodically interrogate the RFID tag 150 positioned at the parking space 130. If the RFID reader 110 interrogates and receives a response from the RFID tag 150, it is assumed that the RFID reader 110 can "see" the RFID tag 150 and therefore the parking space 130 is unoccupied. However, if the RFID tag 150 does not respond, it is assumed that a vehicle located in the space 130 is obscuring the communication with the RFID tag 150. This indicates that the parking space 130 is occupied. The RFID reader 110 can periodically attempt to communicate with the RFID tag 150. When contact resumes (i.e., the RFID tag 150 responds to an interrogation), it is once again assumed that the space 150 is unoccupied.

By positioning RFID readers and RFID tags throughout the parking garage 100, an estimate of the total occupancy can be made. In some examples, the RFID reader 110 reports the occupancy determinations to the central parking system 160. The central parking system 160 includes one or more computing devices that are used to display and record occupancy rates, as described further below.

Figure 2:
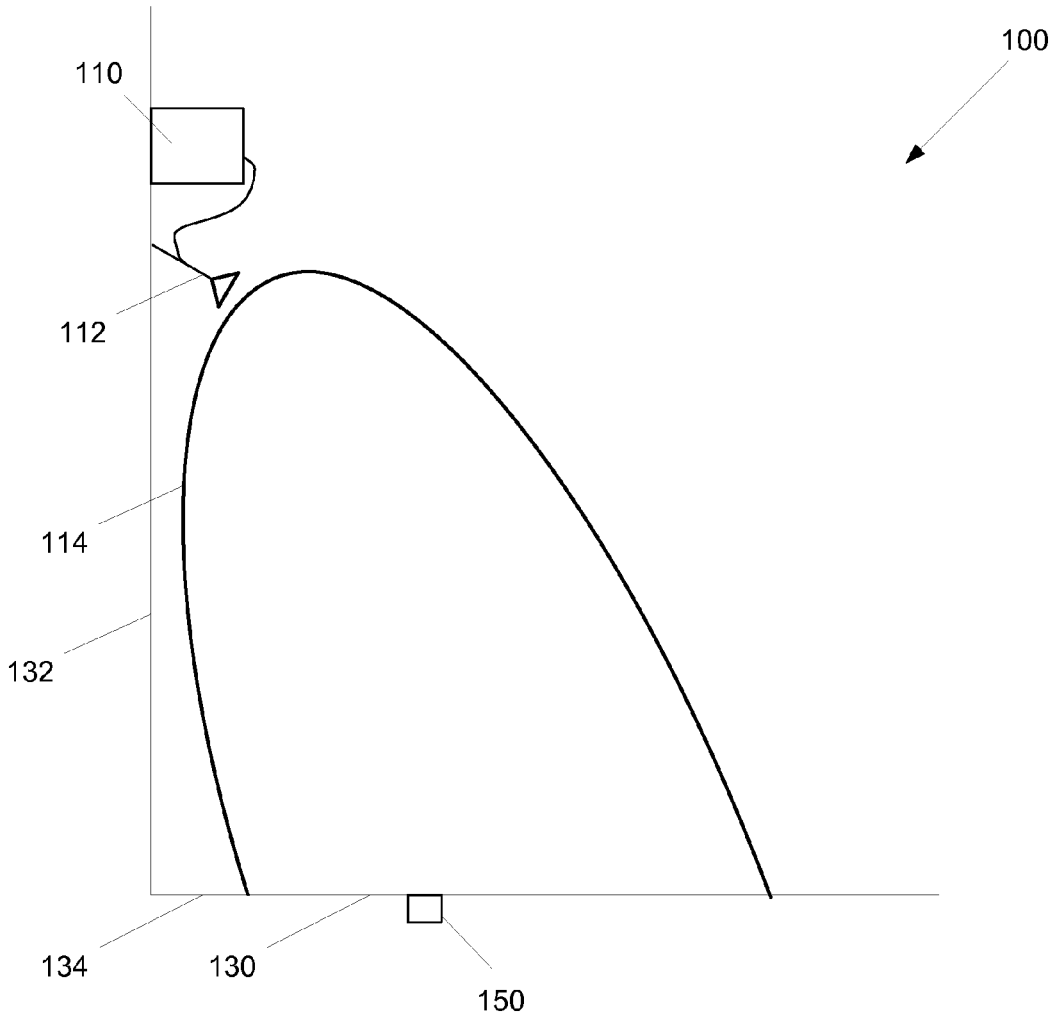
FIG. 2 is a side view of a parking space in a parking garage.
Figure 3:
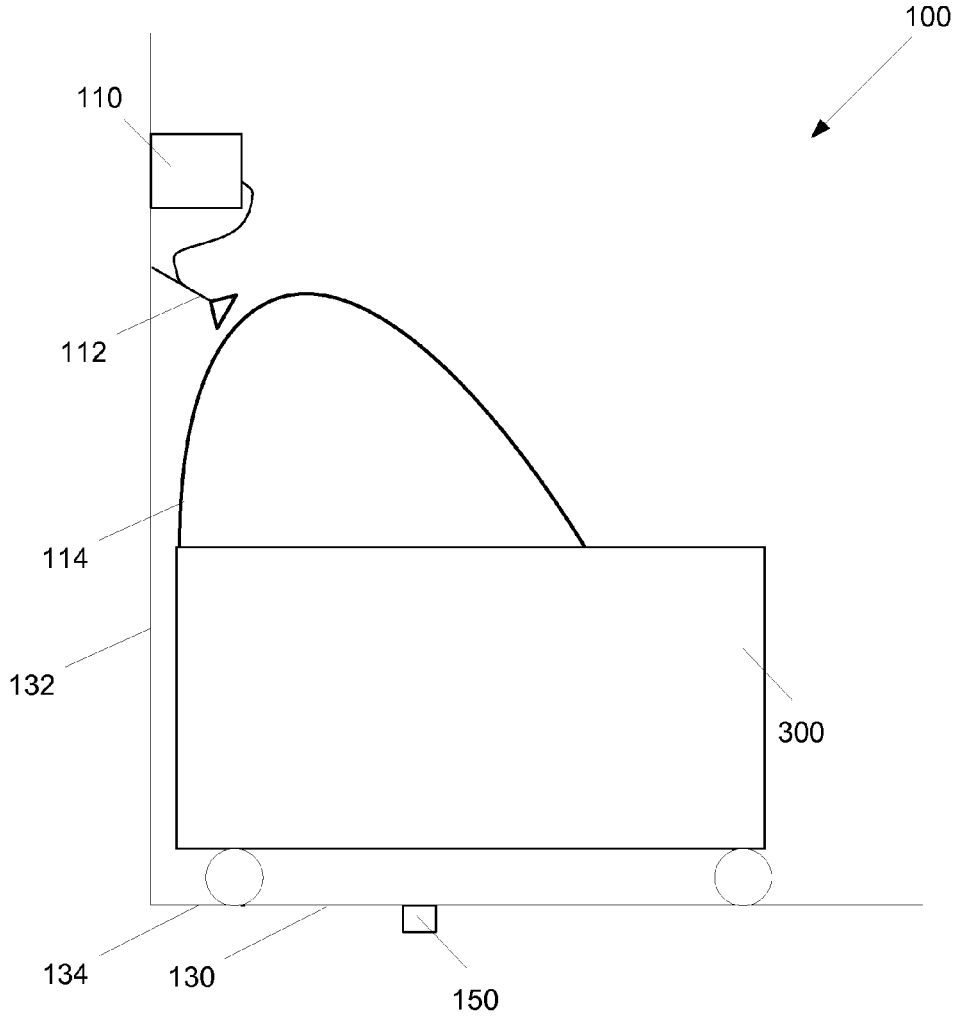
FIG. 3 is a side view of the parking space of FIG. 2 with a vehicle occupying the space.

Referring now to FIGS. 2 and 3, the RFID reader 110 is connected to an antenna 112 mounted on a wall 132 of the parking garage 100. In this example, the antenna 112 is elevated with respect to a floor 134 of the parking garage 100. In other examples, the antenna 112 can be located at different positions. For example, in one alternative, the antenna 112 can be positioned on a ceiling or floor of the parking garage 100. Such repositioning would impact placement of the RFID tags, as described further below.

The RFID tag 150 is shown embedded within the floor 134 at the parking space 130. In some examples, the RFID tag 150 is positioned by drilling a hole within the floor 134, positioning the RFID tag 150 within the hole, and filling a portion of the hole with an epoxy or similar material that would protect and allow the RFID tag 150 to be interrogated by the RFID reader 110. In alternative embodiments, the tag can be affixed to the surface of the floor 134 or positioned in other manners.

The antenna 112 is positioned and configured so that, as the RFID reader 110 interrogates the RFID tag 150, a field 114 generated by the antenna 112 is directed toward the parking space 130 including the RFID tag 150.

In FIG. 2, no vehicle obscures the line of sight between the antenna 112 and the RFID tag 150. In this scenario, the field 114 reaches the tag 150, and a response is directed from the tag 150 back to the antenna 112. Upon receiving the response, the RFID reader 110 assumes that the parking space 130 is unoccupied.

In FIG. 3, a vehicle 300 is shown occupying the space 130. In this scenario, the vehicle obscures the line of sight between the antenna 112 and the RFID tag 150. The field 114 is blocked from reaching the tag 150 by the vehicle 300, so no response is received upon interrogation of the tag 150. The RFID reader 110 therefore assumes that the parking space 130 is occupied.

Figure 4:
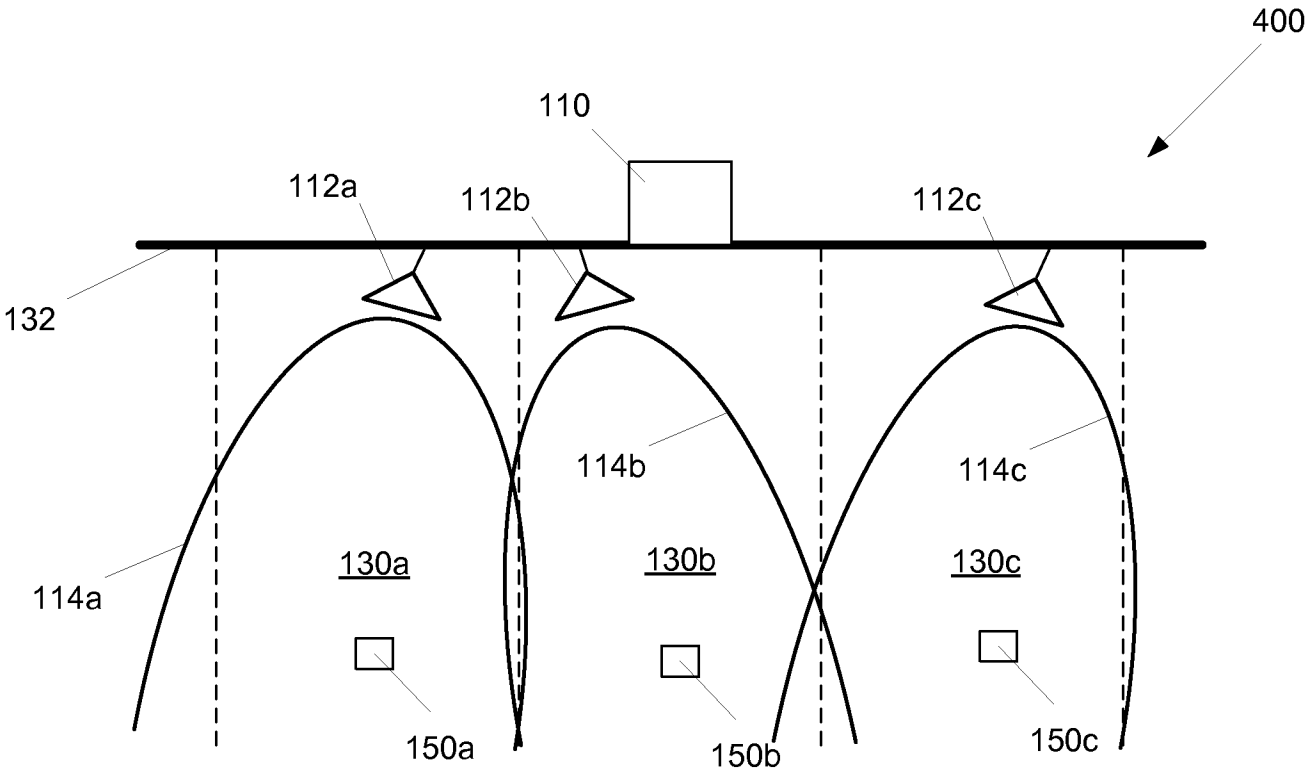
FIG. 4 shows a top view of another parking garage with multiple parking spaces.

Referring now to FIG. 4, a parking garage 400 includes a plurality of antennas 112*a*, 112*b*, 112*c* connected to the RFID reader 110. Each antenna 112*a*, 112*b*, 112*c* is positioned to direct its field 114*a*, 114*b*, 114*c* into a respective parking space 130*a*, 130*b*, 130*c* of the parking garage 400. Each parking space 130*a*, 130*b*, 130*c* includes a respective RFID tag 150*a*, 150*b*, 150*c* positioned therein. The RFID reader 110 can interrogate each of the RFID tags 150*a*, 150*b*, 150*c* using the respective antenna 112*a*, 112*b*, 112*c*. Since each of the RFID tags 150*a*, 150*b*, 150*c* can respond with a unique identifier, the RFID reader 110 can determine which, if any, of the parking spaces 130*a*, 130*b*, 130*c* are occupied by determining which, if any, of the tags 150*a*, 150*b*, 150*c* fail to respond to a read request.

In an alternative embodiment, an antenna can be positioned to cover more than one parking space with its field. For example, the antenna can be configured to cover two or more spaces. See FIG. 5, in which antenna 112*b* is positioned to cover both parking spaces 130*b* and 130*c*. In such a scenario, the RFID reader 110 can determine which, if either, space is occupied by looking at the unique identifier(s) included with any responses from a tag. In such a configuration, a relatively small amount of antennas and RFID readers can be used to cover an area of parking spaces in a parking garage.

Figure 5:
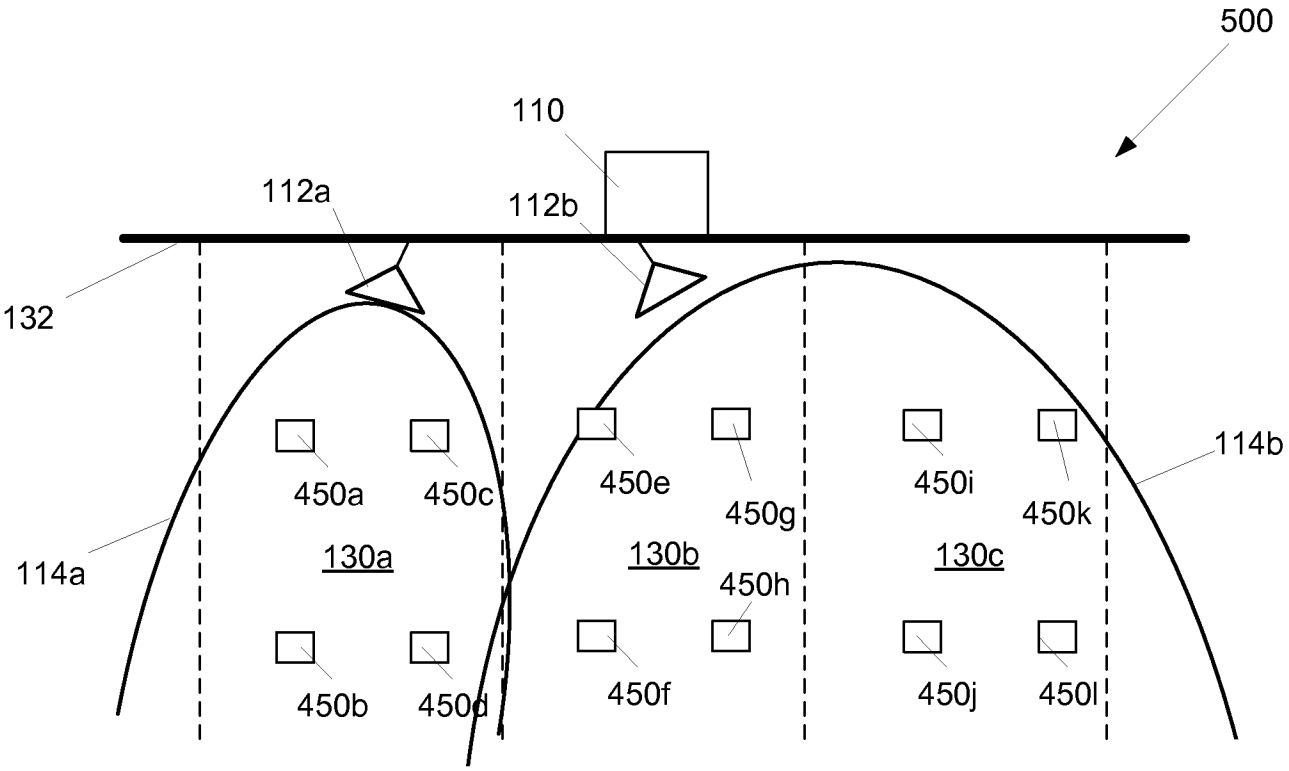
FIG. 5 shows a top view of another parking garage with multiple parking spaces.

Referring now to FIG. 5, a parking garage 500 includes a plurality of RFID tags positioned within each parking space 130*a* (tags 450*a*, 450*b*, 450*c*, 450*d*), 130*b* (tags 450*e*, 450*f*, 450*g*, 450*h*), 130*c* (tags 450*i*, 450*j*, 450*k*, 450*l*). In such a configuration, the RFID reader 110 can not only determine if a parking space is occupied, but also determine where within the parking space the vehicle is parked. Further, if one or more of the tags within a space malfunctions, the occupancy for the space can still be determined using the remaining tags.

For example, if a small vehicle (e.g., a motorcycle) parks within the space 130*b* over RFID tags 450*g*, 450*h*, the RFID reader 110 would receive responses only from the tags 450*e*, 450*f* located within the space 130*b*. Since the RFID reader 110 can determine which tags responded and which did not, the RFID reader 110 can determine that only one-half of the parking space 130*b* is occupied.

In another example, if a vehicle parks over tags 450*c*, 450*d*, 450*e*, 450*f*, the RFID reader 110 can determine that a vehicle has parked straddling the spaces 130*a*, 130*b*. Other configurations are possible.

Figure 6:
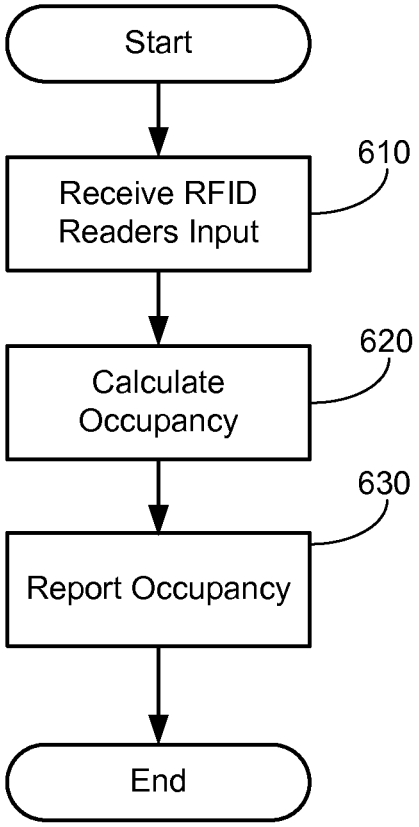
FIG. 6 shows an example method for determining an occupancy of a parking garage.

Referring now to FIG. 6, an example method 600 for determining an occupancy of a parking garage is shown.

Initially, at operation 610, the results of the interrogations by one or more RFID readers are received. For example, multiple readers can be used within a garage to interrogate RFID tags located in each of the parking spaces in the garage. The results of these interrogations can be communicated through wired or wireless technologies to the central station 160. This central station, which can include one or more computing devices, can be used to calculate occupancy rates, as described below.

After the results of each interrogation are received, control is passed to operation 620, and the occupancy for the garage is calculated. For example, the number of vehicles in the garage can be estimated based on the number of spaces including tags that did not respond during the most recent interrogation.

Next, at operation 630, the calculated occupancy can be reported. The reporting can take various forms. For example, if the occupancy rate exceeds a threshold value, signage at the entrances to the garage or at each garage level can be modified to indicate the occupancy status, such as almost full or full. The occupancy can also be illustrated graphically, so that occupied and unoccupied spaces are shown on a graphical user interface for a user. Further, occupancy durations and other metrics (e.g., occupancy per floor, vehicle types, etc.) can also be reported. In other examples, one or more interfaces can be located throughout the parking garage to assist in directing a vehicle to a closest unoccupied space in the garage. Other configurations are possible.

In addition, error statuses can also be reported. For example, as described further below, if an RFID tag does not report within a given time, an error status can be provided so that the tag can be checked to make sure it has not malfunctioned.

Figure 7:
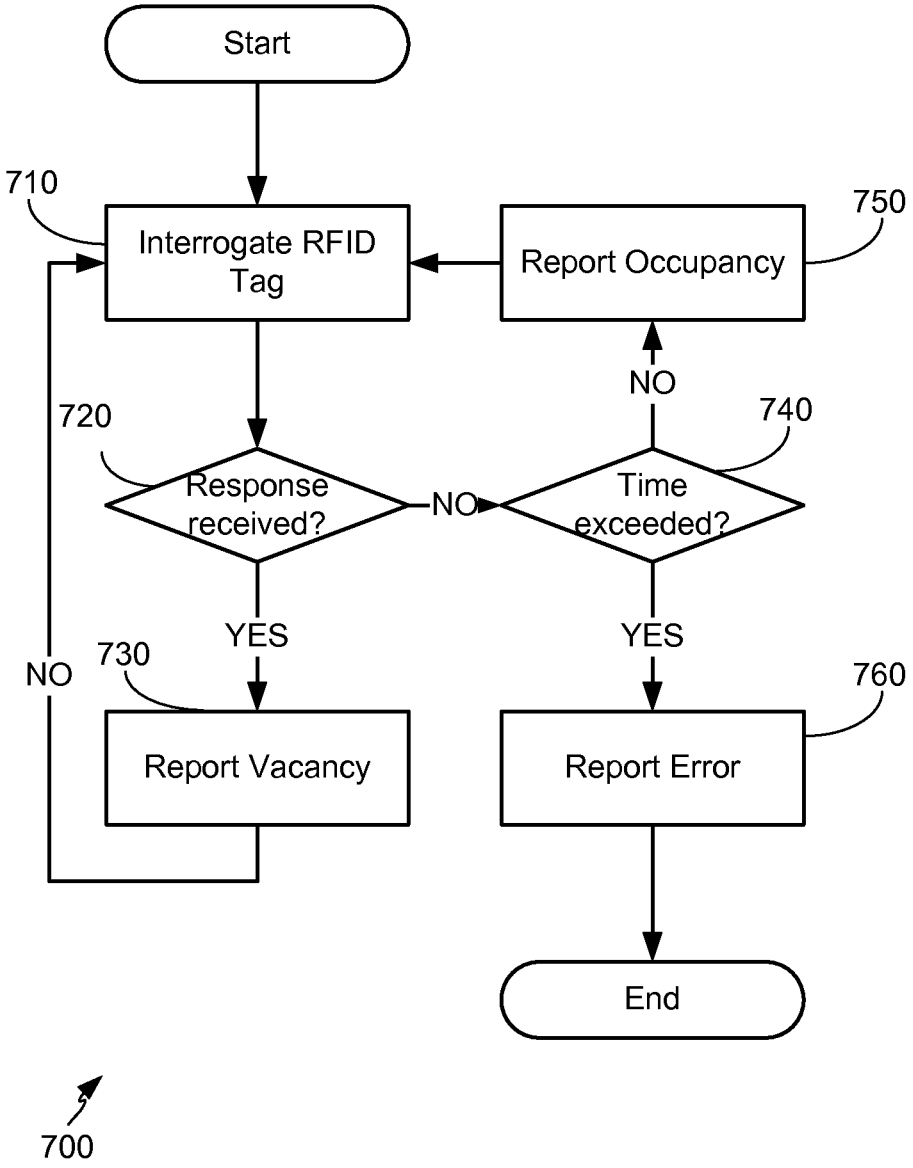
FIG. 7 shows an example method for estimating an occupancy of a given parking space.

Referring now to FIG. 7, an example method 700 for estimating an occupancy of a given parking space is shown. Initially, at operation 710, the RFID tag is interrogated. Next, at operation 720, a determination is made regarding whether or not the tag responded. If not, control is passed back to operation 710, and the RFID tag is interrogated again at some defined frequency (e.g., every millisecond, every second, every five seconds, every ten seconds, etc.).

If the tag does not respond at operation 720, control is instead passed to operation 740. At operation 740, a determination is made regarding whether or not a threshold time period has been exceeded since the last tag response. For example, if a tag fails to respond within a given period of time (e.g., 24 hours, 36 hours, 48 hours etc.), an error status can be provided indicating that the tag could be malfunctioning. If the threshold is exceeded, control is passed to operation 760, and the error status is reported. If the threshold time period has not been exceeded, control is instead passed to operation 750, and the occupancy of the space is reported. Next, control is passed back to operation 710 for the next interrogation at the desired frequency.

Other configurations are possible. For example, in some parking garages, RFID tags are mounted to vehicles that purchase extended (e.g., monthly or yearly) contracts to park at the garage. These tags are used to identify the vehicle upon entry and exit. In such a scenario, the RFID readers can detect one or both of the tags positioned in the floor and on the vehicle to determine where the vehicle is parked and/or to determine that the proper vehicle is parked in the parking space if the space is an assigned space.

In example embodiments, the RFID reader can be any of a number of RFID reader devices, such as the IDentity™ 4100 UHF Reader manufactured by Sirit, Inc. of Toronto, Ontario. Other RFID readers can be used as well.

The RFID tags can be active or passive RFID tags. In some examples, the tags are passive IDentity MaX Pro Transponders manufactured by Sirit, Inc. of Toronto, Ontario. Other RFID tags can be used as well.

Generally, consistent with embodiments of the disclosure, the RFID readers of the present disclosure can include one or more programmable circuits capable of executing program modules. Program modules may include routines, programs, components, data structures, and other types of structures that may perform particular tasks or that may implement particular abstract data types. Moreover, embodiments of the disclosure may be practiced with other computer system configurations, including hand-held devices, multiprocessor systems, microprocessor-based or programmable consumer electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in various types of electrical circuits comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, aspects of the methods described herein can be practiced within a general purpose computer or in any other circuits or systems.

Embodiments of the present disclosure can be implemented as a computer process (method), a computing system, or as an article of manufacture, such as a computer program product or computer readable media. The computer program product may be a computer storage media readable by a computer system and encoding a computer program of instructions for executing a computer process. Accordingly, embodiments of the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media. Further, the disclosed methods' stages may be modified in any manner, including by reordering stages and/or inserting or deleting stages, without departing from the overall concept of the present disclosure.

The above specification, examples and data provide a complete description of the manufacture and use of example embodiments of the present disclosure. Many embodiments of the disclosure can be made without departing from the spirit and scope of the disclosure.

What is claimed is:

1. A system configured to determine a status of a parking space, the system comprising:

an RFID reader; and a plurality of RFID tags positioned at the parking space sized to accommodate a single vehicle;

wherein the RFID reader interrogates the RFID tags;

wherein the RFID reader determines that the parking space is unoccupied when the RFID reader receives a response from the RFID tags;

wherein the RFID reader determines that the parking space is occupied when the RFID reader fails to receive the response from one or more of the RFID tags, and the RFID reader determines where within the parking space the single vehicle is parked; and wherein the RFID reader indicates an error when one or more of the RFID tags fail to respond within a given period of time, the error indicating a possible malfunction of the system.

2. The system of claim 1, wherein the RFID reader periodically interrogates the RFID tags.

3. The system of claim 1, wherein the RFID tags are embedded in a floor of the parking space.

4. The system of claim 1, wherein a vehicle positioned in the parking space obscures communication between the RFID reader and the RFID tags when the parking space is occupied.

5. A parking garage, comprising:

a plurality of parking spaces;

at least one RFID reader;

at least one antenna coupled to the RFID reader; and a plurality of RFID tags positioned in one of the parking spaces sized to accommodate a single vehicle, wherein the RFID tags are embedded into a floor of the one parking space;

wherein the RFID reader uses the antenna to interrogate the RFID tags;

wherein the RFID reader determines that one of the parking spaces is unoccupied when the RFID reader receives a response from the RFID tags;

wherein the RFID reader determines that one of the parking spaces is occupied when the RFID reader fails to receive the response from the RFID tags, and the RFID reader determines where within the parking space the single vehicle is parked; and wherein the RFID reader indicates an error when the RFID tags fails to respond within a given period of time, the error indicating a possible malfunction of the system.

6. The parking garage of claim 5, wherein the RFID reader periodically interrogates the RFID tags.

7. The parking garage of claim 5, wherein a vehicle positioned in the parking space obscures communication between the RFID reader and the RFID tags when one of the parking spaces is occupied.

* * * * *